US007757310B2

(12) United States Patent
Wong

(10) Patent No.: US 7,757,310 B2
(45) Date of Patent: Jul. 20, 2010

(54) IMPACT PROTECTION DEVICE

(75) Inventor: Jon G. Wong, Long Beach, CA (US)

(73) Assignee: Shock Doctor, Inc., Plymouth, MN (US)

( * ) Notice: Subject to any disclaimer, the term of this patent is extended or adjusted under 35 U.S.C. 154(b) by 1143 days.

(21) Appl. No.: 11/034,235

(22) Filed: Jan. 12, 2005

(65) Prior Publication Data

US 2005/0268387 A1 Dec. 8, 2005

Related U.S. Application Data

(60) Provisional application No. 60/536,021, filed on Jan. 12, 2004, provisional application No. 60/536,087, filed on Jan. 12, 2004, provisional application No. 60/536,020, filed on Jan. 12, 2004.

(51) Int. Cl.
*A41D 27/26* (2006.01)

(52) U.S. Cl. ..... 2/466

(58) Field of Classification Search ..... 2/23, 2/400, 403, 404, 406, 407, 466; 128/846, 128/891; 602/67, 70, 71, 72
See application file for complete search history.

(56) References Cited

U.S. PATENT DOCUMENTS

| | | | | |
|---|---|---|---|---|
| 849,471 | A | | 4/1907 | Gamble |
| 1,688,676 | A | | 10/1928 | Whitley |
| 1,720,439 | A | | 7/1929 | Richardson |
| 1,830,572 | A | | 11/1931 | Taylor |
| 2,283,684 | A | | 5/1942 | Matthews |
| 3,176,686 | A | | 4/1965 | Barnes |
| 3,782,375 | A | | 1/1974 | Donars |
| 3,787,892 | A | | 1/1974 | Quinn |
| 3,788,314 | A | | 1/1974 | Noreen |
| D246,011 | S | | 10/1977 | Eckman |
| 4,134,400 | A | | 1/1979 | DiMatteo |
| D252,116 | S | | 6/1979 | DiMatteo |
| 4,257,414 | A | | 3/1981 | Gamm et al. |
| 4,453,541 | A | | 6/1984 | Castelli et al. |
| 4,471,772 | A | | 9/1984 | Miller |
| 4,484,360 | A | * | 11/1984 | Leighton et al. ..... 2/22 |
| 3,229,692 | A | | 1/1986 | Creed |
| 4,660,554 | A | | 4/1987 | Wright |
| D294,075 | S | | 2/1988 | Bernstein |
| 4,870,958 | A | | 10/1989 | Webster |
| 4,922,899 | A | | 5/1990 | Graff et al. |
| 4,967,768 | A | * | 11/1990 | Tatro ..... 128/891 |
| 4,989,594 | A | | 2/1991 | Doherty et al. |
| 5,239,706 | A | | 8/1993 | Stevenson |
| 5,274,854 | A | | 1/1994 | Wenner et al. |
| 5,405,312 | A | * | 4/1995 | Jacobs ..... 602/5 |

(Continued)

FOREIGN PATENT DOCUMENTS

| | | |
|---|---|---|
| CA | 1 290 098 | 10/1991 |

*Primary Examiner*—Shaun R Hurley
*Assistant Examiner*—Andrew W Sutton
(74) *Attorney, Agent, or Firm*—Faegre & Benson LLP

(57) ABSTRACT

In one embodiment, the present invention provides an impact protection device including a base member, a cushioning layer secured to a peripheral edge of the base member and an impact shield operatively attached to an outer surface of the base member. The impact shield may be deflectable and/or moveable relative to the base member, and may be attached to the base member at a plurality of discrete locations.

35 Claims, 14 Drawing Sheets

U.S. PATENT DOCUMENTS

| | | | | | |
|---|---|---|---|---|---|
| D364,262 | S | | 11/1995 | Magidson et al. | |
| 5,479,942 | A | | 1/1996 | DiMatteo | |
| 5,557,804 | A | * | 9/1996 | Ovortrup et al. | 2/23 |
| 5,819,323 | A | * | 10/1998 | Edenfield | 2/466 |
| 5,920,914 | A | | 7/1999 | Dempsey | |
| 6,041,441 | A | | 3/2000 | Counts | |
| 6,048,327 | A | * | 4/2000 | Kieffer | 602/70 |
| 6,319,219 | B1 | | 11/2001 | Landi | |
| D457,690 | S | | 5/2002 | Griffiths | |
| 6,979,325 | B2 | | 12/2005 | Reddy | |
| 7,004,921 | B2 | | 2/2006 | Littell | |
| 7,216,371 | B2 | | 5/2007 | Wong | |
| 2003/0163076 | A1 | | 8/2003 | Lukens | |
| 2004/0024341 | A1 | | 2/2004 | Jacobs | |
| 2005/0278839 | A1 | | 12/2005 | Atwater et al. | |

* cited by examiner

IMPACT PROTECTION DEVICE

CROSS-REFERENCE TO RELATED APPLICATIONS

The present application claims priority to U.S. Provisional Application Ser. Nos. 60/536,021 entitled "Chin Cup," 60/536,087 entitled "Jock Cup," and 60/536,020 entitled "Supporter Briefs," each of which was filed on Jan. 12, 2004, and is hereby expressly incorporated by reference in its entirety.

BACKGROUND

Protective cups are well known and extensively utilized for protection during athletic competition, as well as certain occupational and other non-athletic activities, for protection against external impact forces. For example, such protective cups may be used to protect a user's groin, elbows, or knees from impact.

Jock cups are normally positioned within a pouch of a jockstrap type of athletic supporter, and is intended to physically shield the user's groin area from physical impact. Such cups normally define a cavity area, which is designed to encase the male genitals, and a resilient rubber covered edge portion surrounding the cavity. Cups of this character may be molded from a semi-rigid material or a rigid plastic material such as polypropylene or polyethylene as disclosed in U.S. Pat. No. 4,134,400, which is sufficiently rigid to retain its shape even when struck by a relatively severe blow.

Chin cups are normally secured to a helmet or other form of headgear via one or more straps members to protect a user's chin. Conventional chin cups are often molded from a single semi-rigid plastic material.

During athletic competition, impact forces to the groin or chin region are often directed perpendicularly towards the body. However, it is not uncommon for impact forces to be directed generally upward, or angularly upward, somewhat parallel to the axis of the body, which may cause conventional cups to be pushed upward with the force of the blow, so that the cup becomes dislodged from its original and intended positioning. As a result, conventional cups may not adequately protect against injury, or may itself cause considerable pain or injury.

SUMMARY

In one embodiment, the present invention provides an impact protection device for positioning over or adjacent a body part of a user. The cup includes a base member having a generally concave inner surface, a generally convex outer surface and a perimeter edge, and generally defines a cavity for positioning over a user's body part. The cup further includes an impact shield operatively attached to the base member. The impact shield may be movable and/or deflectable relative to the base member, and may be operatively attached to the base member at one or more discrete locations. The cup may also optionally include a cushioning layer surrounding at least a portion of the perimeter edge of the base member.

The cup may include one or more shock absorbers adjacent the impact shield and base member. In one embodiment, the shock absorber may be formed from several components. First, the shock absorber may include a connecting means such as a rivet, clip, integral multiple layer molding, etc., which attaches the impact shield to the base member, while allowing limited relative movement between the impact shield and base member. The shock absorber may also include a cushion disposed between the impact shield and the base member. Additionally, the impact shield may be configured to direct an impact force towards the connecting means and/or cushion.

The impact protection device may be configured for positioning adjacent the groin of a user, and may further include a cup support for retaining the device adjacent the user's groin. Alternatively, the device may be configured for positioning over a user's chin, and may include straps for attachment to a helmet or other headgear.

In an alternate embodiment, the impact protection device may include a base member as reported above, which includes a padding layer adapted to contact a body part of a user. The device may further include an impact shield having regions which engage the base member and regions which do not engage the base member. For example, a peripheral edge of the impact shield may have portions attached to the base member and portions which are not attached to the base member.

DETAILED DESCRIPTION

Figure 1:
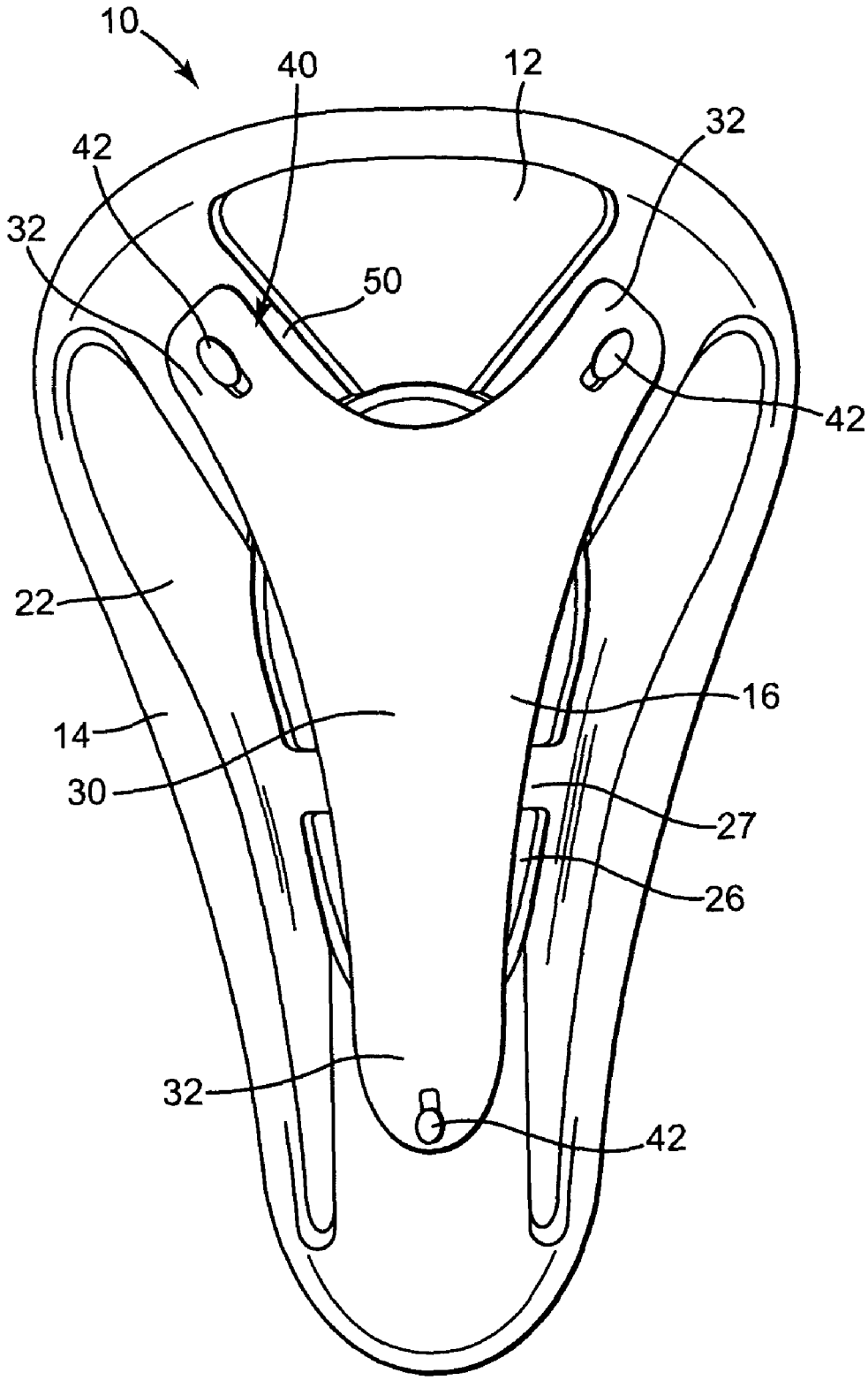
FIG. 1 illustrates a front view of a cup in accordance with an embodiment of the present invention.
Figure 2:
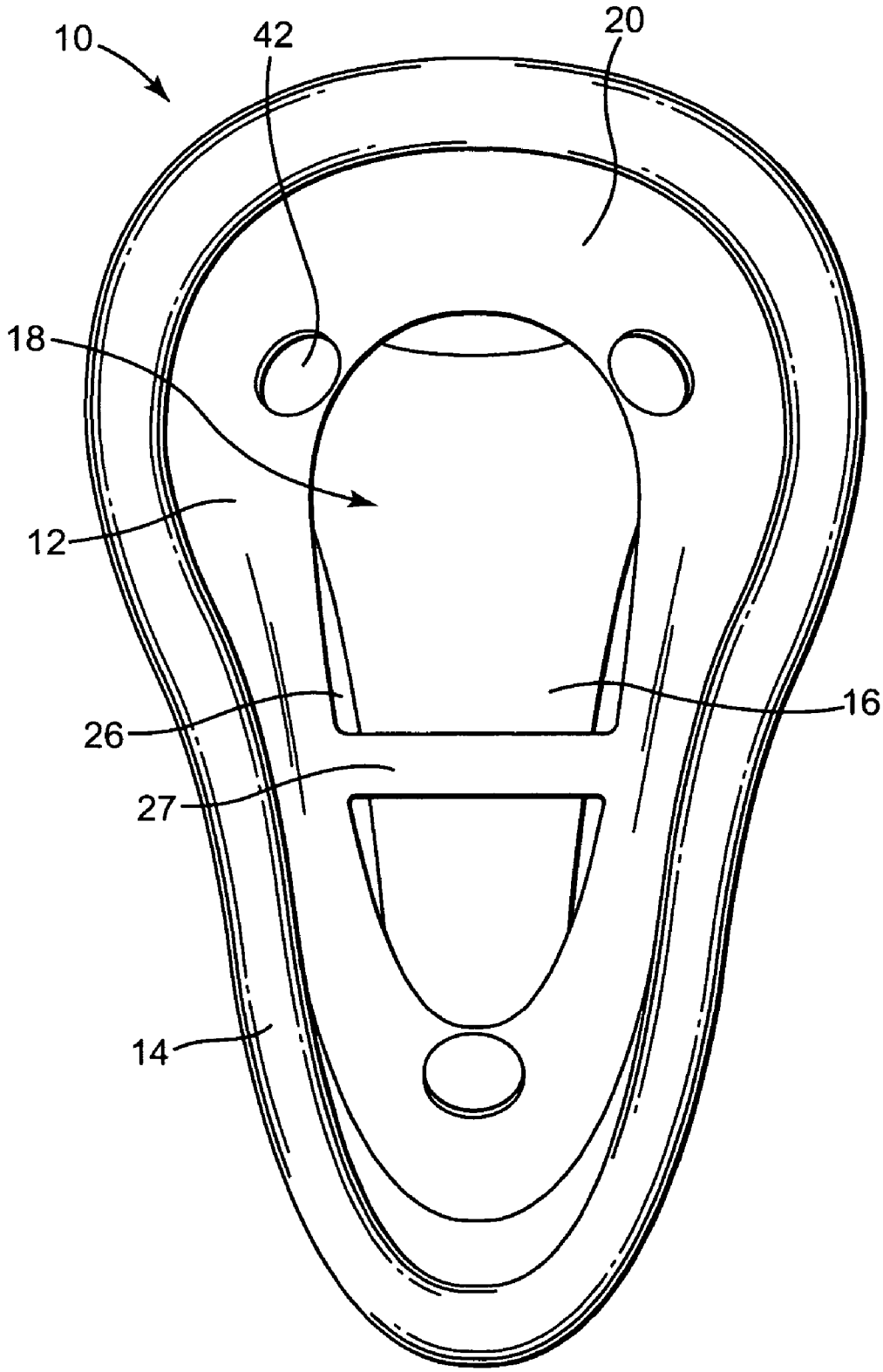
FIG. 2 illustrates a rear or inside view of the cup shown in FIG. 1.

In one embodiment, the present invention provides an impact protection device that utilizes a multi-stage impact protection approach to reduce, redirect, distribute or otherwise dissipate the impact force applied to the body part of a user. Although the figures discussed below are directed to specific embodiments of the present invention for protecting the groin and chin respectively, the multi-stage impact approach exemplified in the figures could be used to protect other body parts, including the elbow, knee and/or head or the user.

FIGS. 1-4 illustrate respective front, rear, side and exploded views of a device 10 for protecting a user's groin according to one embodiment of the present invention. The device 10 generally includes a base member 12, a cushioning layer 14 and an impact shield 16. The device generally has a cup-shaped configuration, which defines a cavity 18 for positioning over the groin of the user.

As shown in FIGS. 1-4, the base member 12 is generally shaped similarly to a conventional jock cup (such as that described in U.S. Pat. No. 6,048,327 to Kieffer, U.S. Pat. No. 4,453,541 to Castelli et al. and U.S. Pat. No. 4,257,414 to Gamm et al., which are incorporated herein by reference), and includes a generally concave inner surface 20, a generally convex outer surface 22, and a peripheral edge 24. However, the base member 12 also includes apertures 26 at an apex of the base member 12 such that the remaining portion of the base member 12 generally resembles a frustum of a customary cup. The apertures 26 are separated by an optional bridge 27, which may provide additional structural support to the device 10. The apertures 26, in combination with the impact shield 16, provide a venting feature for the device 10, and may also affect the manner in which the device 10 dissipates an impact force.

The base member 12 may be formed from a generally rigid or semi-rigid material or composite of materials. To the extent that the base member 12 deforms upon the application of an internal (e.g. a force caused by the user) or external force, the material should be sufficiently resilient to allow the base member 12 to return to its original shape. Suitable materials for use in the base member 12 include a variety of polymers and mixtures of polymers, including polycarbonate, high density polyethylene, polypropylene, and other shatter and/or crack resistance materials such as those reported in U.S. Pat. No. 3,229,692 to Creed, which is expressly incorporated herein by reference. Composite materials such as glass or fiber-reinforced polymers (e.g. Kevlar®) may also be suitable in certain embodiments.

The cushioning layer 14 is attached to (or integrally formed onto) the peripheral edge 24 of the base member 12, and generally acts as a resilient padding between the base member 12 and the user. In the illustrated embodiment, the cushioning layer 14 surrounds the peripheral edge 24 and extends part way along both the inner and outer surfaces 20, 22 of the base member 12. As described below, a portion of the cushioning layer 14 may also extend between the portions of the inner member 12 and impact shield 16.

The cushioning layer 14 may be formed from deformable, but generally resilient materials, including natural rubbers, elastomers, ethyl vinyl acetate, urethanes such as a heat formed thermoplastic urethanes, foams and the like.

The impact shield 16 is attached to (or integrally formed onto) and extends over a portion of the outer surface 22 of the base member 12. In the illustrated embodiment, the impact shield 16 generally includes a central portion 30, which extends at least partially over apertures 26 of base member 12 to provide ventilation. The impact shield further includes a plurality of leg or peripheral portions 32, which attach to base member 12. In the embodiment illustrated in FIGS. 1-4, the impact shield 16 is shaped to generally resemble the letter "Y," such that the impact shield 16 has three leg portions 32. Only the leg portions 32 are attached to the base member 12 at discrete (i.e. separate) locations such that central portion 30 does not contact or engage the base member 12 when the device 10 is in a static position (i.e. when no impact force has been applied to the device). Alternatively, central portion 30 may contact bridge 27 to provide increase structural support. The impact shield 16 generally possesses a contour corresponding to the generally convex contour of the outer surface 22 of the base member 12.

The impact shield 16 may be formed from a generally rigid or semi-rigid material or composite of materials. Like the base member, the impact shield 16 may be formed from a material that deforms upon the application of a force. However, the material may also be sufficiently resilient to allow the impact shield 16 to rapidly return to its original shape. Suitable materials for use in the impact shield 16 include a variety of polymers and composites of polymers, including polycarbonate, high density polyethylene, polypropylene, and other polymeric shatter and/or crack resistance materials such as those reported in U.S. Pat. No. 3,229,692 to Creed, which is expressly incorporated herein by reference. Composite materials such as glass or fiber-reinforced polymers (e.g. Kevlar®) may also be suitable.

In one embodiment, the impact shield 16 may be more rigid than the base member 12. This may be accomplished by forming the impact shield 16 from a material or composite of materials having a higher rigidity than the material or composite of materials used to form the base member 12. The impact shield 16 may also be configured to have a greater thickness (or be more structurally reinforced) than the base member 12. In certain embodiments, the impact shield may have a non-uniform thickness to increase protection against impact forces at specific angles, directions and/or magnitudes.

Figure 3:
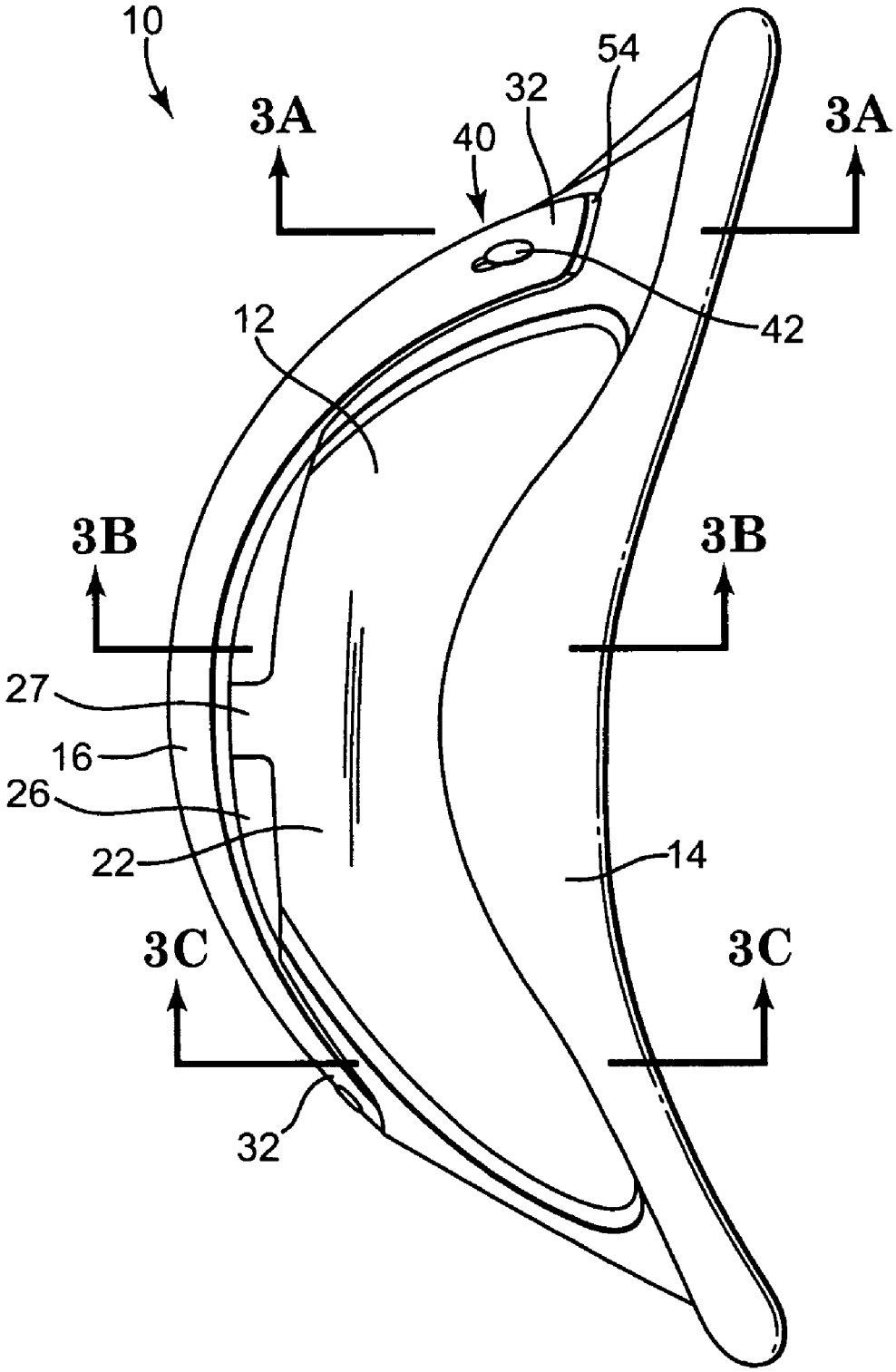
FIG. 3 illustrates a side view of the cup shown in FIG. 1.
Figure 3A:
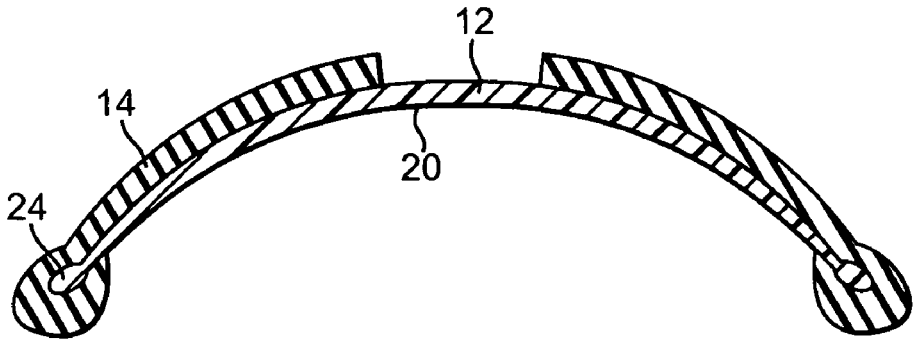
FIGS. 3A-3C illustrate cross-sections of the cup shown in FIG. 1 along a vertical or longitudinal axis of the cup.
Figure 3B:
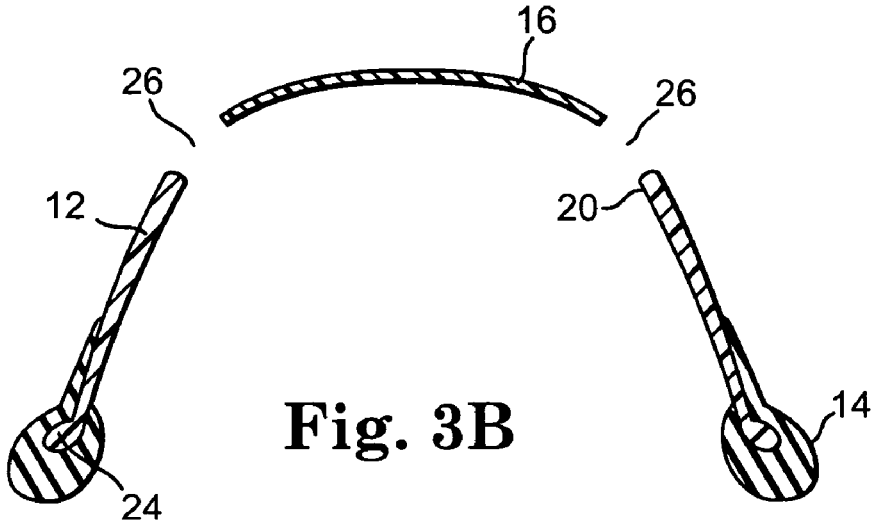
Figure 3C:
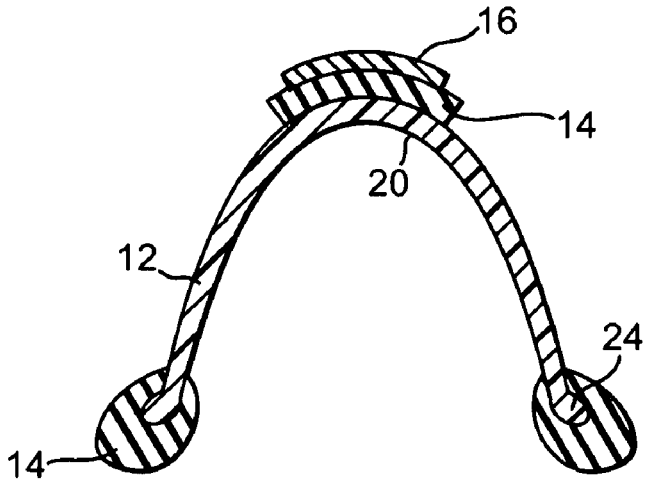
Figure 4:
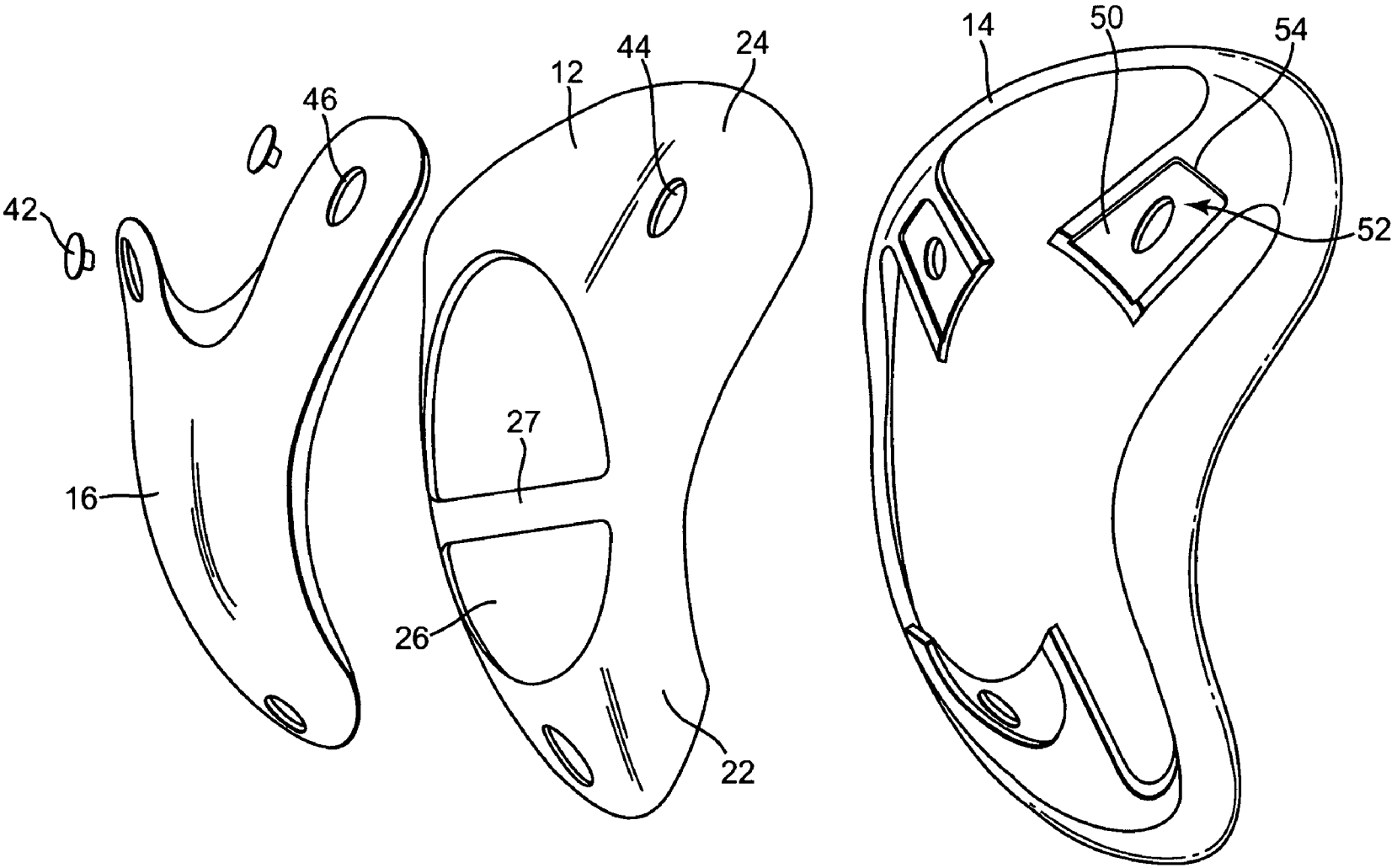
FIG. 4 illustrates an exploded parts view of the cup shown in FIG. 1.

FIGS. 3A-C show a cross-sectional view of the device 10 along a generally longitudinal (or vertical) axis of the device 10. As can be seen from these figures, the severity of the arc of the cross-section of the device 10 gradually increases from the top (FIG. 3A) of the device 10 down to the bottom (FIG. 3C) of the cup 1 for increased comfort during use.

In the embodiments illustrated in FIGS. 1-4, the device 10 further includes a one or more shock absorbers 40 operatively connected to the impact shield 16 of the base member 12. A wide range of shock absorber configurations may be used. In the illustrated embodiments, the shock absorber 40 includes multiple components. A first component is connecting means 42 (e.g. a rivet, screw, bolt, dowel, etc.), which extends between aperture 44 in the base member 12 and slot 46 in impact shield 16 to moveably secure the impact shield 16 to the base member 12. More particularly, the slot 46 is sized to allow the connecting means 42 to move relative to the slot 46 to provide limited relative movement between the impact shield 16 and the base member 12 when a force is applied to the impact shield 16. Alternatively, the slot 46 could be formed in the base member 12 rather than the impact shield 16 to accomplish generally the same result. Although slot 46 is shown as being non-circular, slot 46 could be formed as a circular aperture having a sufficient diameter to provide limited movement between impact shield 16 and base member 12.

In an alternate embodiment, connecting means 42 may not be a separate component such as a rivet, etc., but may instead be accomplished via an integral molding of the impact shield 16, base member 12 and/or shock absorber 40. In this embodiment, movement and/or deflection may be provided by the deformable and/or resilient properties of the various components.

Another component of the illustrated shock absorber system is a shock cushion 50 disposed between the leg portion 32 of the impact shield 16 and base member 12 such that the connecting means 42 extends through the shock cushion.

In the illustrated embodiment, the shock cushion 50 is an extension of the compressible layer 14, and includes a channel 52 into which a portion of the leg 32 of the impact shield 16 resides. The channel 52 includes a stop 54 that the end of the leg 32 resides near or abuts against when in a static position, and which affects the relative movement between the impact shield and the base member during impact. Optionally, the shock cushion 50 may be formed with a series of ridges inside the channel 52, which may also impact the relative movement between the impact shield 16 and the base member 12. An additional component of the shock absorbers 40 include the leg 32 of the impact shield 16, which interact with both the connecting means 42 and the cushion 50 in the illustrated embodiments In operation, the device 10 of the present invention dissipates impact force in several ways. As used herein, the term "dissipate" generally refers to the absorption, deflection, transfer, distribution, redirection or other control of an impact force to reduce or minimize the effect of the force on the user of the impact device 10.

Figure 5:
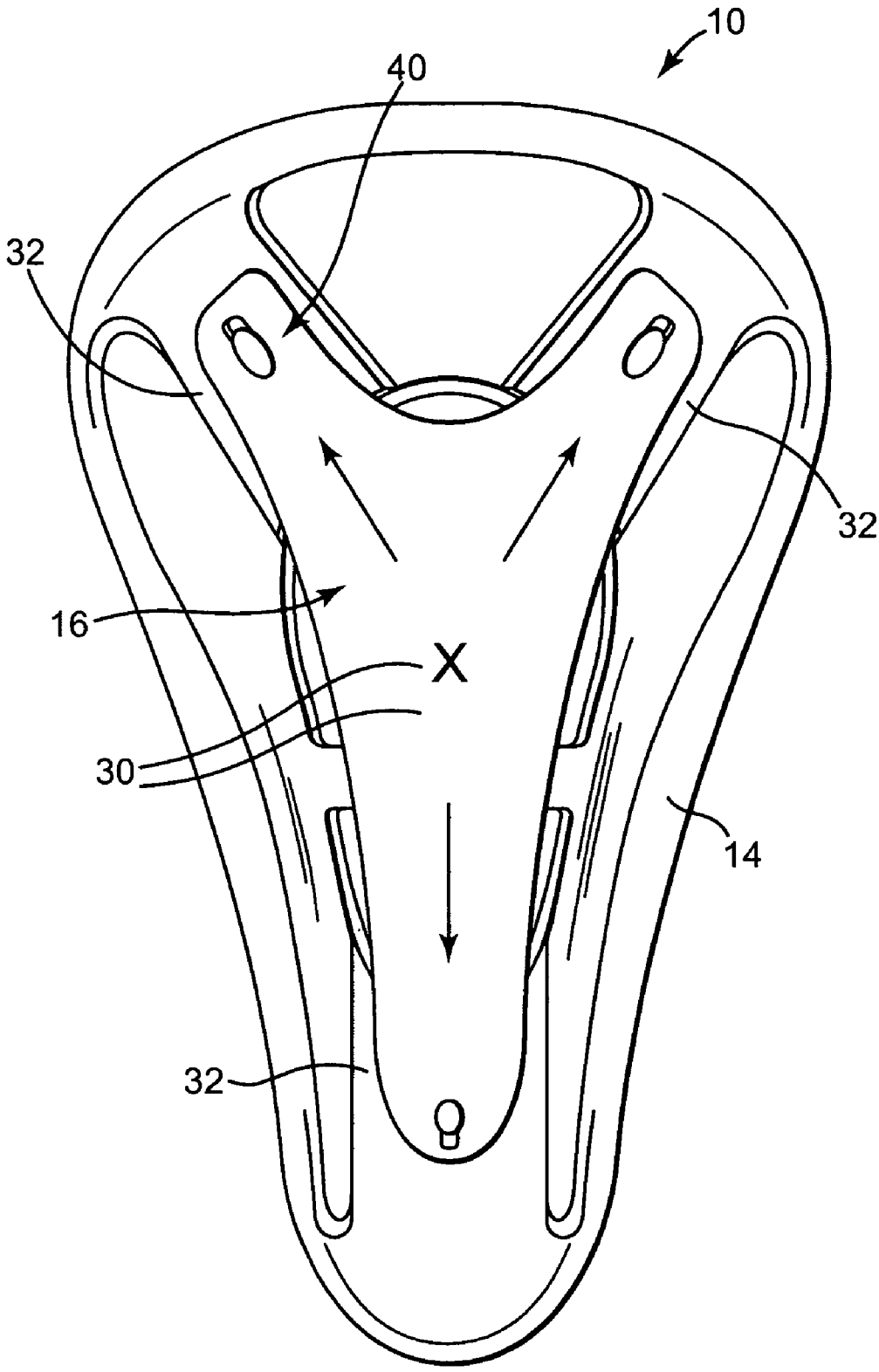
FIG. 5 illustrates a front view of the cup shown in FIG. 1 after receiving an impact force.
Figure 6:
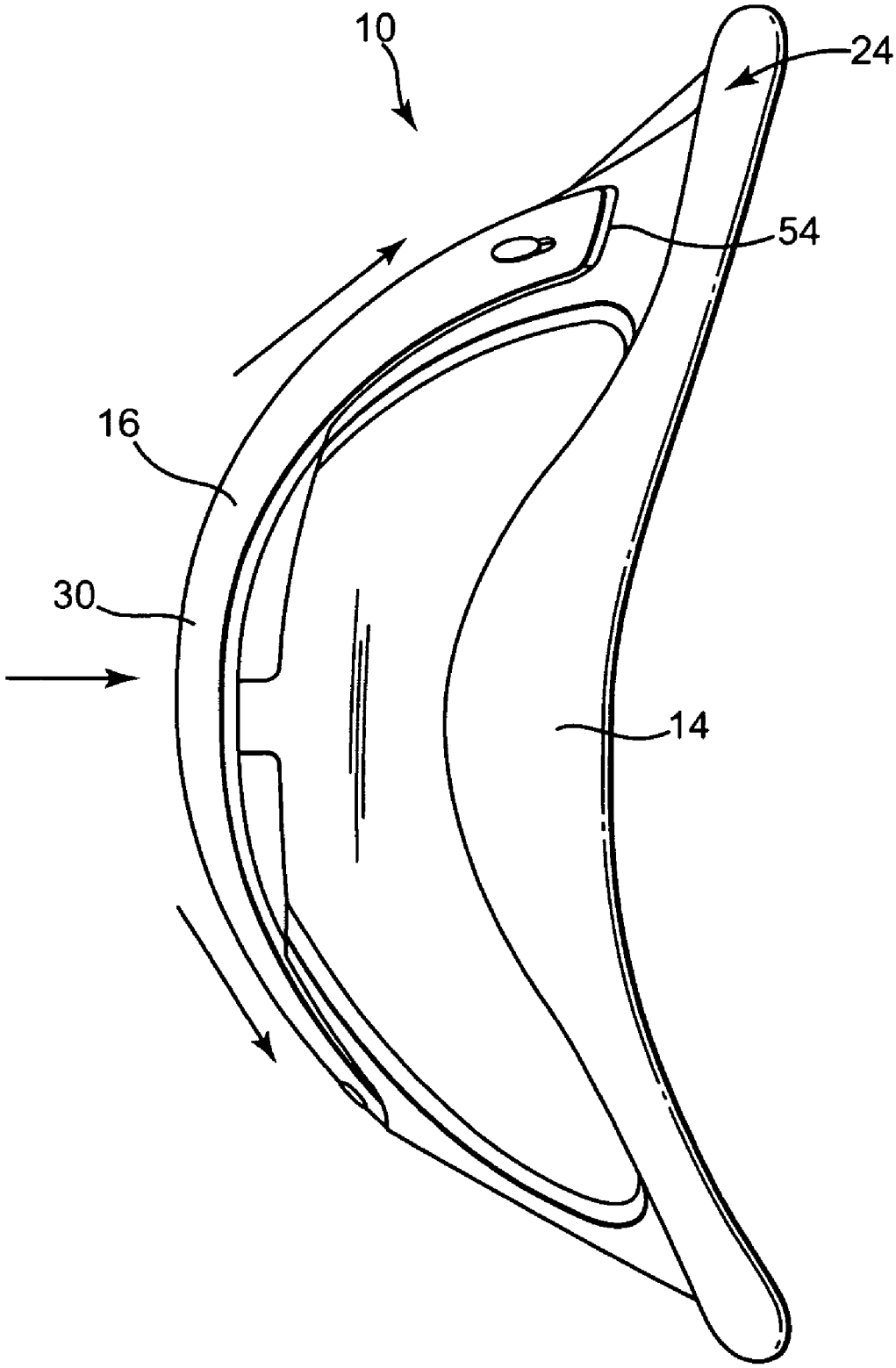
FIG. 6 illustrates a side view of the cup shown in FIG. 1 after receiving an impact force.

FIGS. 5-6 illustrate the device 10 of FIGS. 1-4 when an impact force ("X") is applied to the central portion 30 of the impact shield 16. Depending on the severity and location of the impact force on the impact shield 16 and the particular configuration of the device 10, the impact shield 16 may dissipate some of impact force by deforming slightly upon impact, such that the generally arcuate profile flattens inwardly towards the base member 12 (see FIG. 6). Whether or not the impact shield 16 deforms, residual impact force is, as indicated by the arrows, redirected from the central portion 30 of the impact shield 16, to the leg portions 32.

More specifically, as the impact force is directed along the leg portions 32, one or more of the leg portions 32 may move relative to the base member 12 towards the peripheral edge 24 of the base member 12 to the extent allowed by the movement of the connecting means 42 within the slots 46. However, as the leg portion 32 moves, it redirects the impact force into the shock cushion 50, including in particular the stop 54. In this manner, at least some of the impact force directed through the leg portions 32 is absorbed by the shock cushion 50.

Furthermore, because the shock cushion 50 and impact shield 16 are formed from resilient materials, these components rapidly return to their static position after the initial application force. In this manner, the impact shield 16 and shock absorber(s) 40 independently or together act as a spring means to absorb some impact force and to deflect some impact force outwardly from the device 10. As noted above for example, when the leg portion 32 contacts against the stop 54 in the shock cushion 50, the stop 54 opposes or resists the movement of the leg portion 32. This causes deflection of the leg portion 32 relative to the central portion 30 of the impact shield 16. Alternatively or additionally, the channel portion 52 of the shock cushion(s) 50 may have a ramp or incline to further resist or oppose the movement of leg portion 32.

Residual impact force not dissipated by the impact shield 16 and the shock absorbers 40 is redirected into the base member 12. More particularly impact force is redirected into discrete locations of the base member 12, and generally away from the body party (e.g., the groin), being protected. Like the impact shield 16, the base member 12 is formed from a semi-rigid and resilient material. Thus, the base member 12 is capable of dissipating residual impact force.

Residual impact force not dissipated by the base member 12 is directed toward the peripheral edge 24 of the base member 12 and into the cushion layer 14, which is positioned between the base member 12 and the user. The cushion layer 14 also absorbs residual impact force, thus minimizing or reducing the impact felt by the user and directing the impact away from the protected body part.

The manner in which the device 10 dissipates a particular impact force will depend on the magnitude, direction and contact location of the impact force. One of the benefits of the present invention is that impact force dissipates over multiple stages such that impact forces of various magnitudes and from a variety of directions can be effectively dissipated.

Of course, the particular configuration of the device, and in particular the configuration of the impact shield 16, will also affect how impact force is dissipated. Although the three-leg impact shield 16 illustrated in FIGS. 1-6 may be particularly suitable for certain applications, other shapes having two, four or more legs can also be used as could other shapes that provide the intended function of the impact shield. For example, the ends of the three legs of the "Y" design could be flared and the shock cushions 50 could be enlarged to increase absorption and/or transfer areas of the impact shield 16 and shock cushion.

Figure 7:
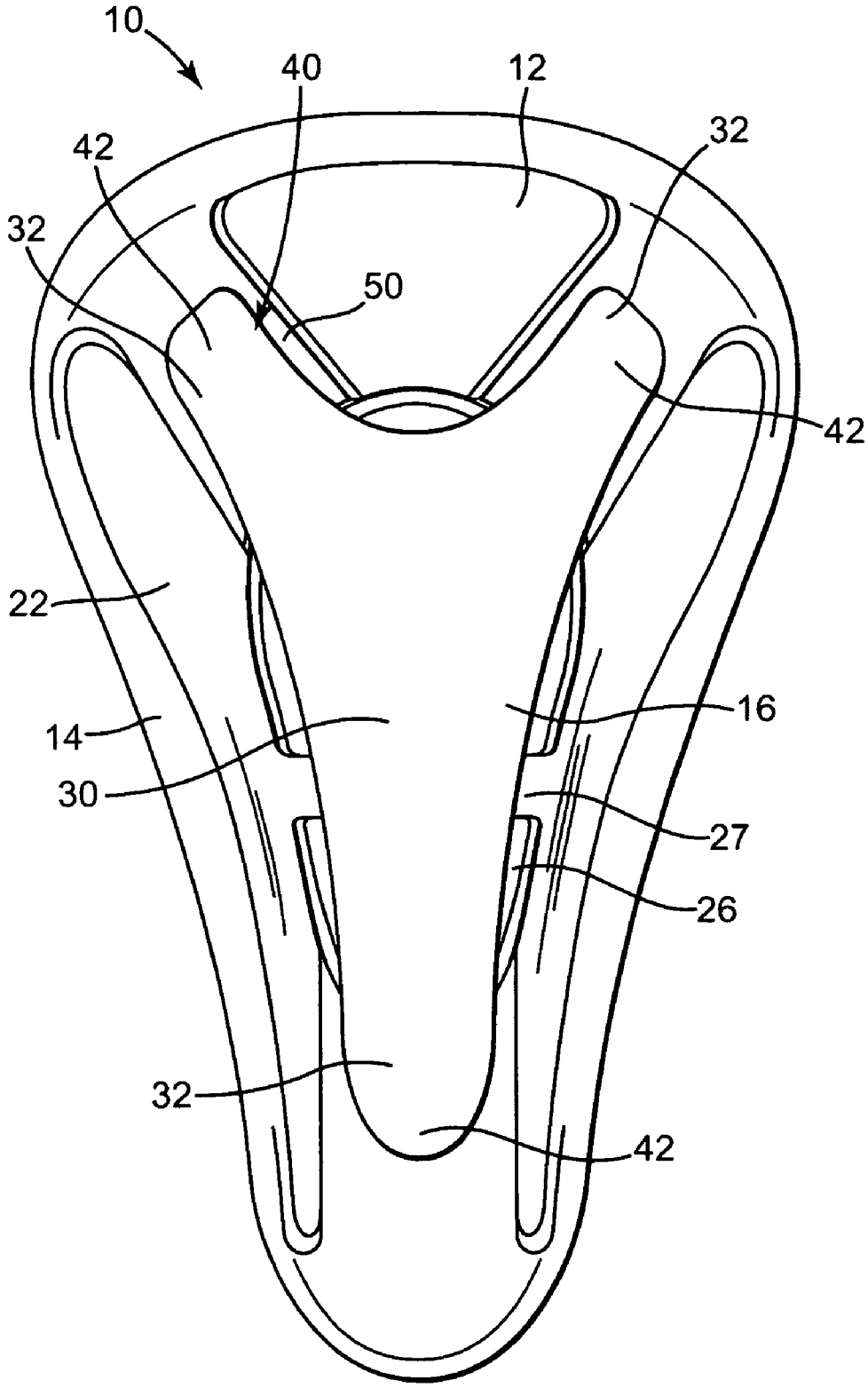
FIG. 7 illustrate a front view of a cup in accordance with an embodiment of the present invention.
Figure 8:
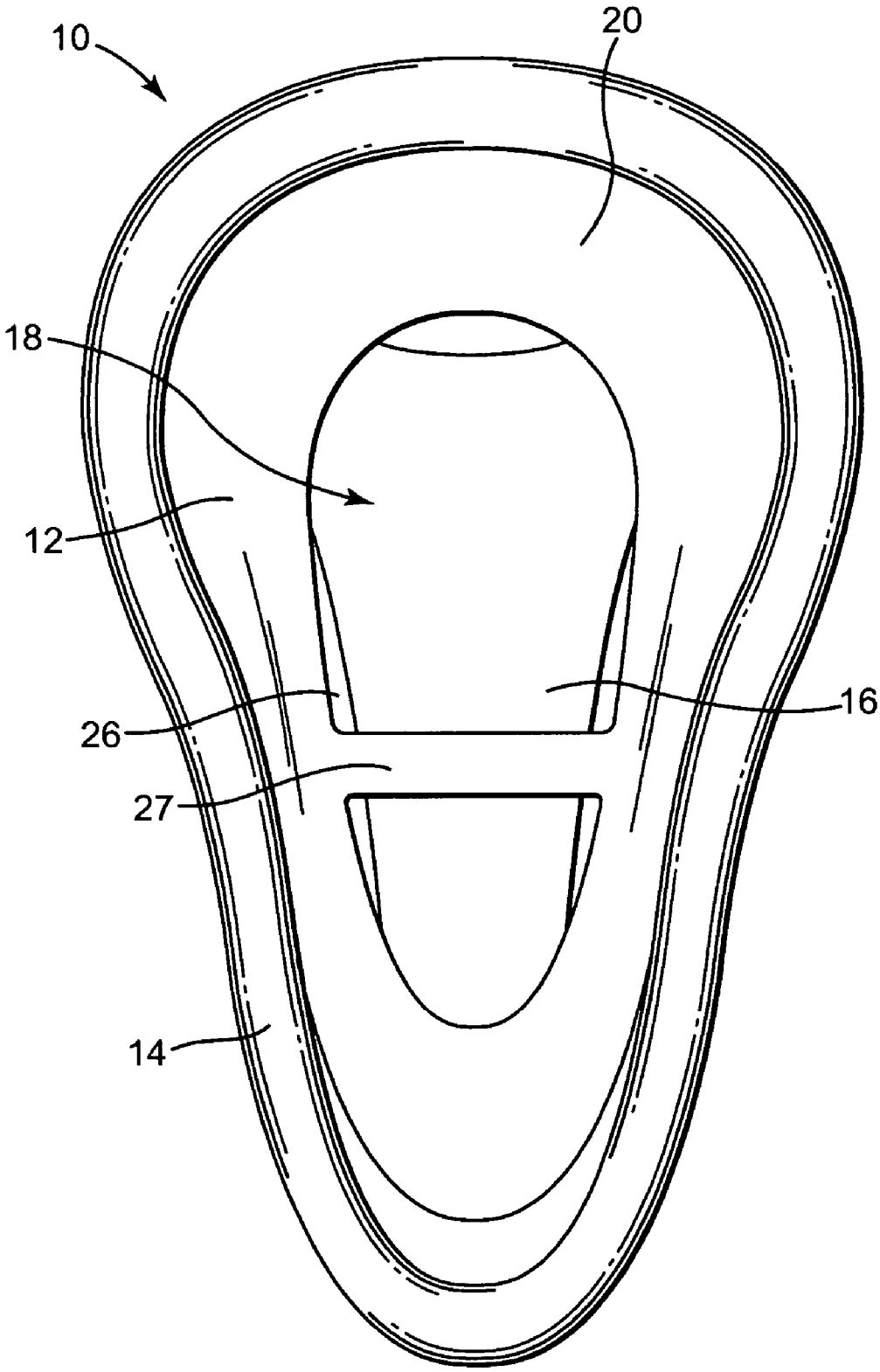
FIG. 8 illustrates a rear or inside view of the cup shown in FIG. 7.

In an alternate embodiment shown in FIGS. 7-8, impact shield 16 is integrally formed with base member 12, and shock cushion 50 is formed around leg portions 32 of impact shield 16 to provide connection means 42. In this embodiment, the deflectability of the impact shield and base member and the discrete positioning of leg portions 32 may effectively dissipate impact force as described above with respect FIGS. 1-6.

The device 10 of the present invention is designed to be secured to a user with conventional jock straps, and may also be used with short-style jock supports, such as the shorts described and claimed in the U.S. patent application entitled "Jock Support Short," which was filed concurrently with this application (identified by application Ser. No. 11/034,203, now U.S. Pat. No. 7,216,371) and is hereby expressly incorporated by reference in its entirety.

Figure 9:
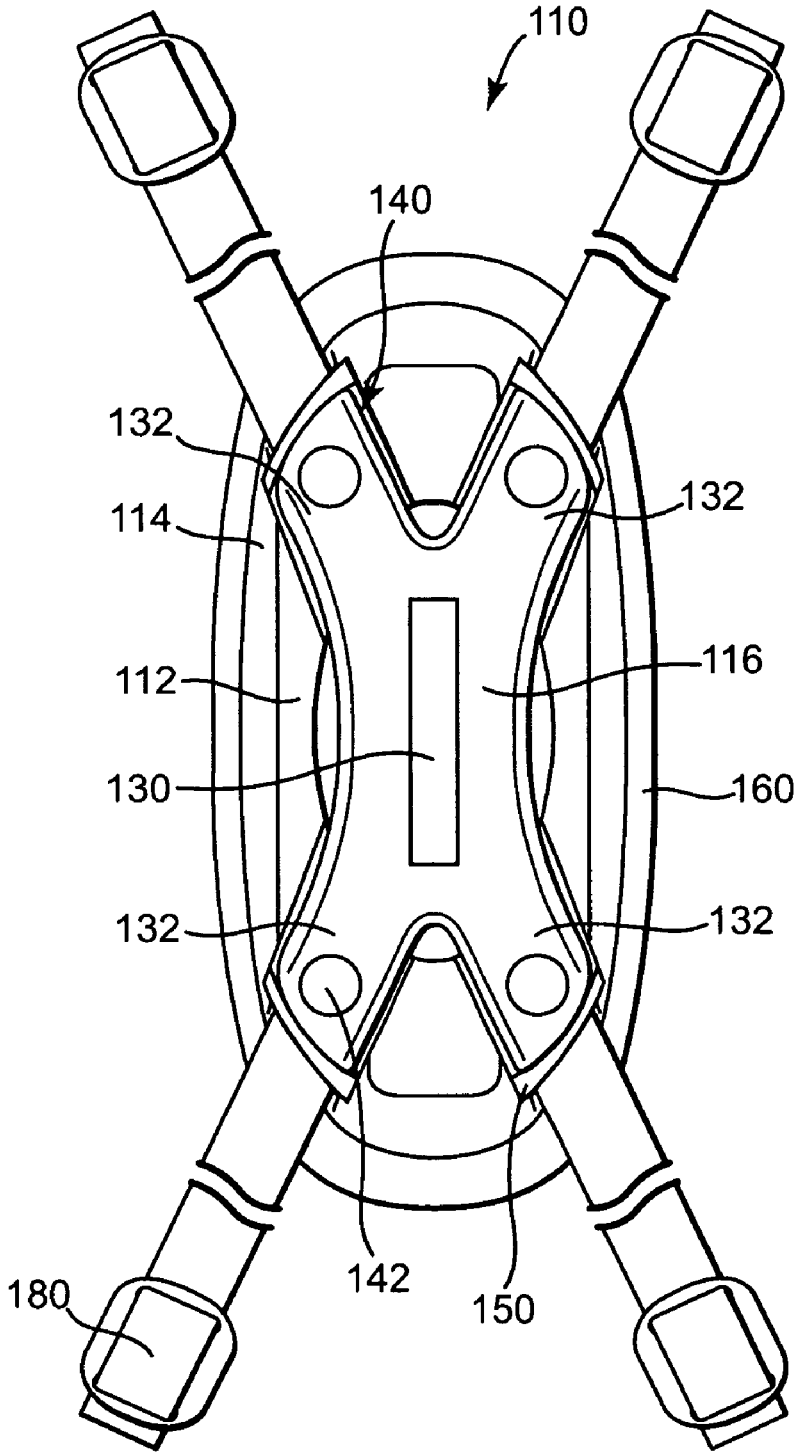
FIG. 9 illustrates a front view of a cup in accordance with an embodiment of the present invention.
Figure 10:
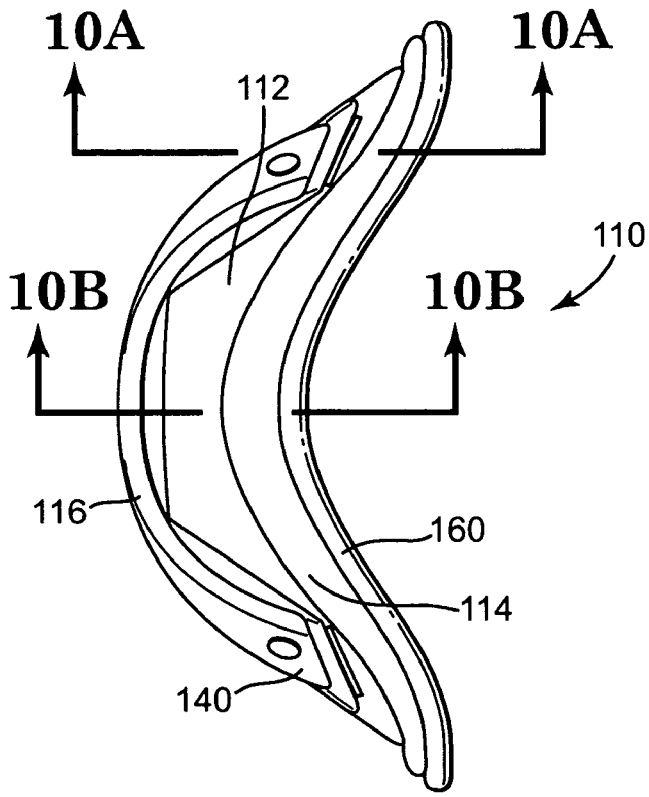
FIG. 10 illustrates a side view of the cup shown in FIG. 9.
Figure 11:
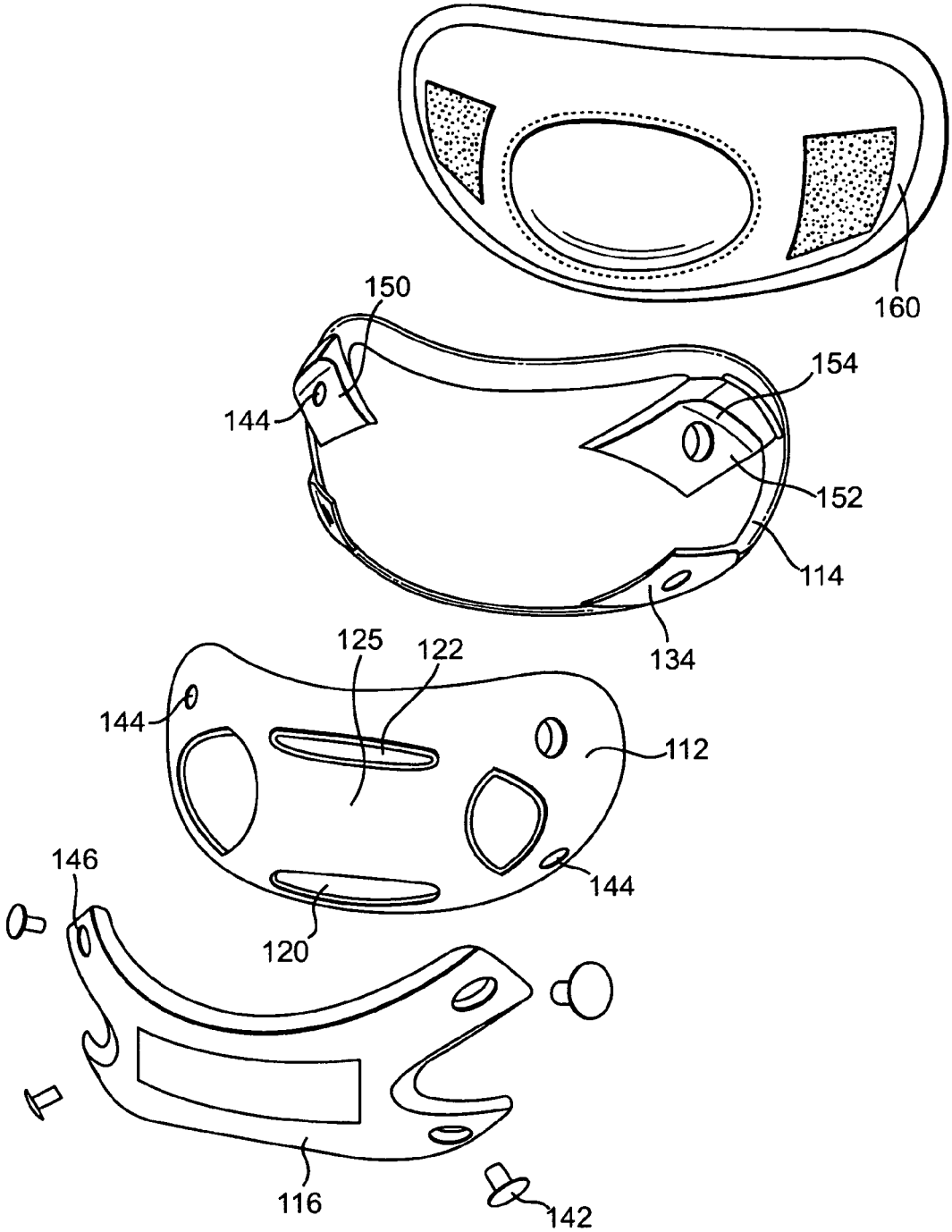
FIG. 11 illustrates an exploded view of the cup shown in FIG. 9.

FIGS. 9-11 show respective front, side and exploded views of a device 110 according to one embodiment of the present invention, which is designed to protect a user's chin. Similar to the device 10 illustrated in FIGS. 1-6, the device 110 includes a base member 112, a cushion layer 114, an impact shield 116 and shock absorbers 140. Each of these components has been configured to dissipate force directed to a user's chin.

Figure 10A:
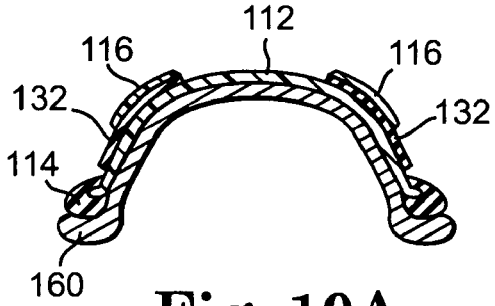
FIGS. 10A-10B illustrate cross-sections of the cup shown in FIG. 9 along a horizontal axis of the cup.
Figure 10B:
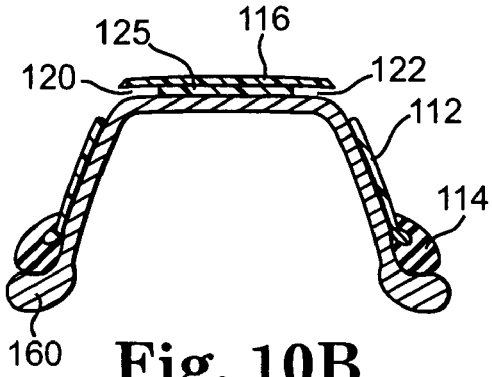

Referring to FIGS. 10A-10B, the device 110 possesses a generally arcuate shape along a longitudinal (or horizontal) cross-section. However, the severity of the arc of the cross section of the device 110 is greater at the center of the device 110 (FIG. 10A) than at the ends of the device 110 (FIG. 10B). Also, the portion of the arc representing the lower portion of the device 110 is shown as being slightly longer than the upper portion of the device 110.

The base member 112 includes two openings 120, 122 separated by a bridge 125. The openings 120, 122 may provide ventilation, while the bridge 125 may provide additional structural support to the device 110.

The impact shield 116 of device 110 is configured as an "X" shape having a central portion 130 and four legs 132. Each leg 132 attaches to the base member 112 at a discrete location, and is operatively associated with a shock absorber 140.

The four-leg design of this embodiment is configured to dissipate an impact force directed toward the chin. As noted above with respect to the device 10 illustrated in FIGS. 1-8, other shapes having two, three, five or more legs can also be used, as could other shapes that provide the intended function of the impact shield. For example, the ends of the four legs 132 of the "X" design could be flared and the shock absorbers 140 could be enlarged to increase absorption and/or transfer areas of the impact shield 16 and shock absorbers 140. Similarly to the device 10 for protection the groin of user, the device 110 dissipates an impact force by redirecting the impact force towards the legs 132. Of course, depending on the exact location and magnitude of the impact force, the force could be more localized toward one of the legs 132 than the other, or could be more evenly distributed toward multiple legs 132.

The shock absorber 140 is similar to that used in the device 10 illustrated in FIGS. 1-8, in that it also includes connecting means 142 that engage with aperture 144 on the base member 112 and the slot 146 in the impact shield 116. A shock cushion 150 including a channel 152 and a stop 154 is also included. Alternatively, connecting means 142 may be accomplished by intergrally molding the various components.

In addition to the above-described components, the device 110 may further include a padding layer 160 that is attached to and extends within the cavity formed by the device 110. The padding layer 160 may be removably attached by a Velcro-type fastener. The padding layer 160 may absorb residual impact force, and may also add comfort for the user.

Figure 12:
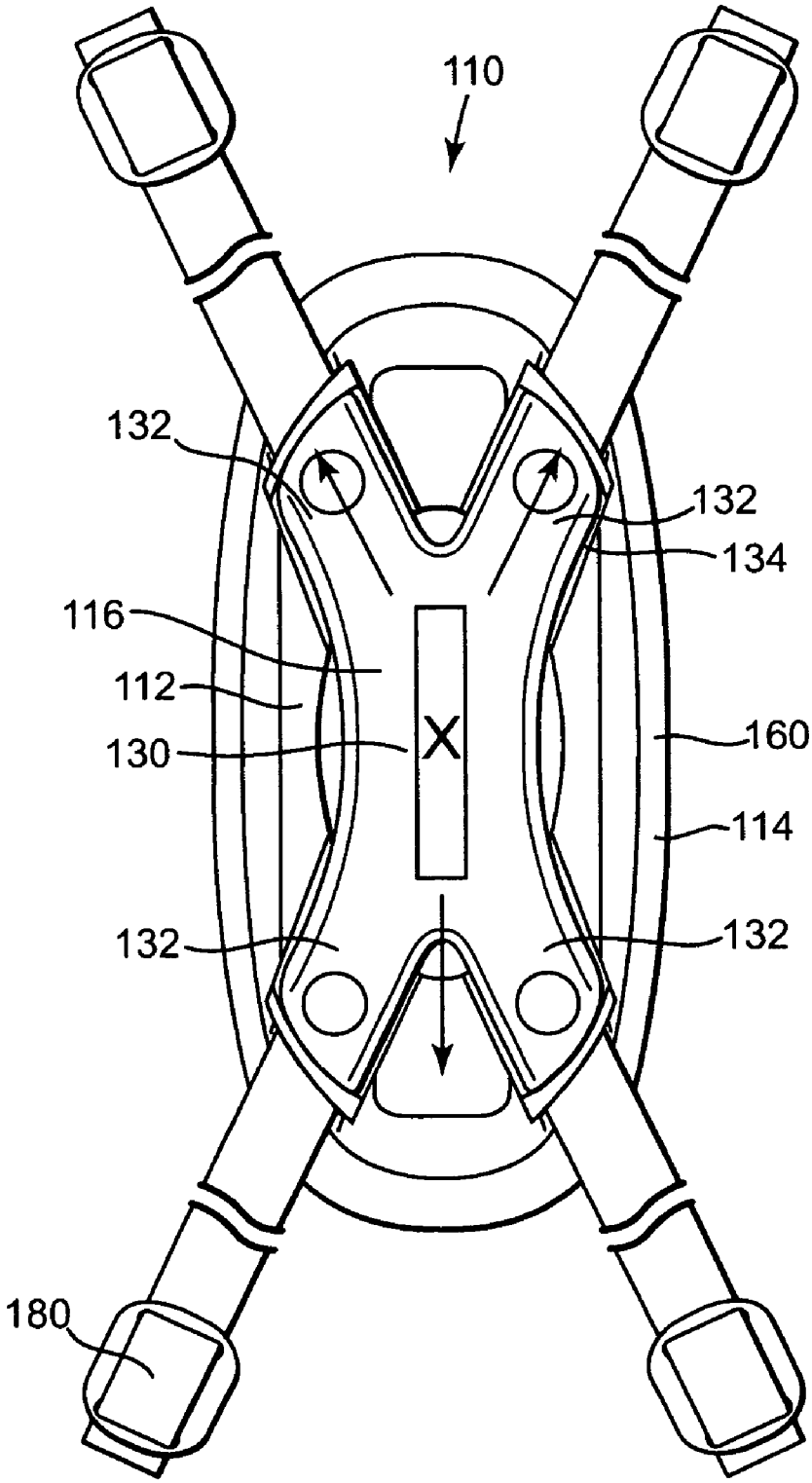
FIG. 12 illustrates a front view of the cup shown in FIG. 9 after receiving an impact force.
Figure 13:
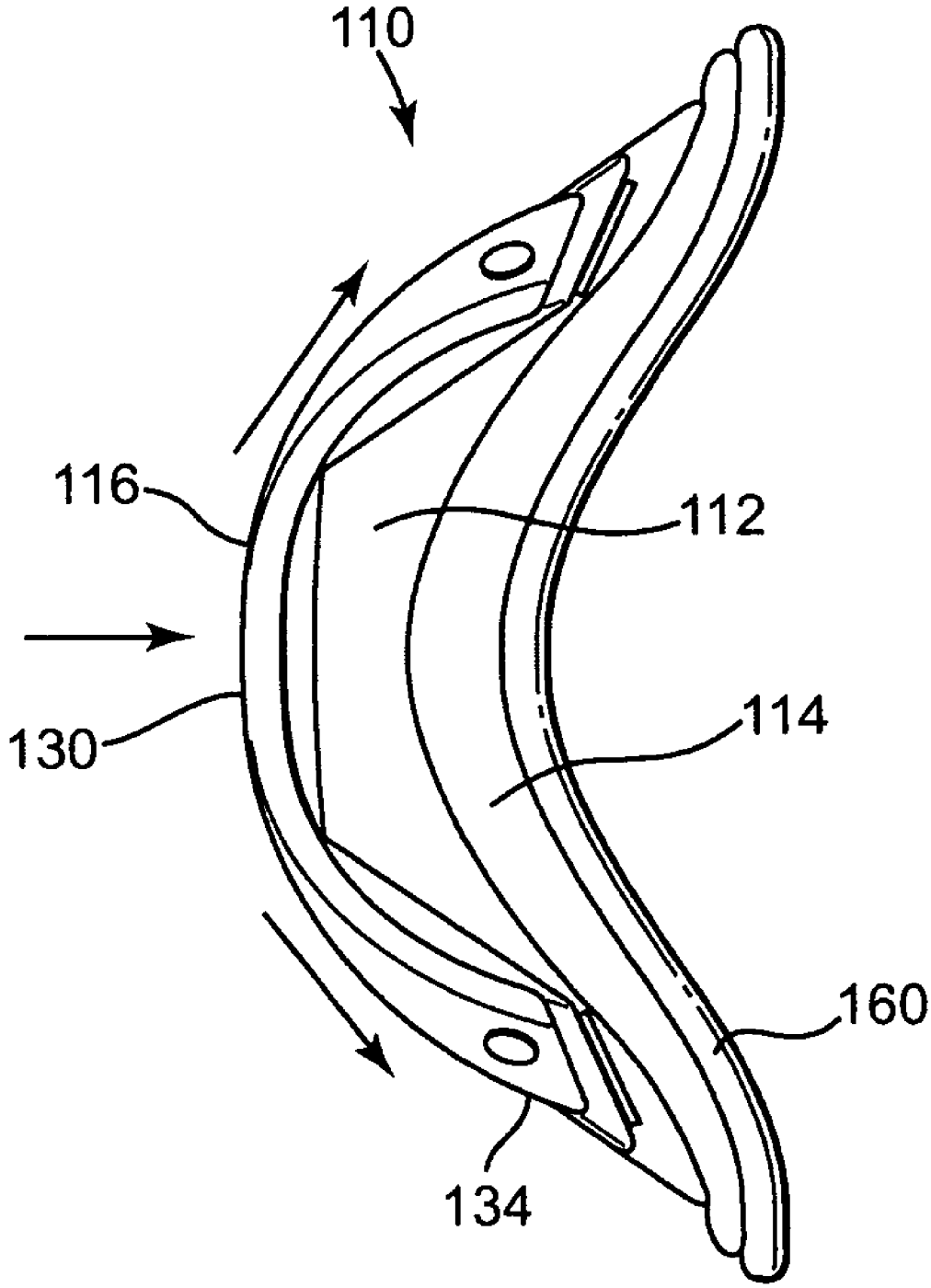
FIG. 13 is a side view of the cup shown in FIG. 9 after receiving an impact force.

Depending on the magnitude, direction and location of an impact force, the device 110 will function similarly to the device 10 illustrated in FIGS. 5-6. Referring to FIGS. 12-13, when an impact force strikes the impact shield 116, the impact shield 116 may absorb a portion of the impact force, deflect a portion of the impact force 160 via the spring-like response of the impact shield, and redirect a portion of the impact force through the one or more of the legs 132 and into the shock absorber 140. The shock absorber 140, and specifically the shock cushion 150 may dissipate additional impact force. Residual impact force may be redirected into the base member 112 and towards peripheral edge 124. The base member 112 may dissipate additional impact force, and may redirect impact force into the compressible layer 114. Finally, the optional padding layer 160 may additionally dissipate residual impact force.

Although FIGS. 1-13 are directed to specific embodiments, the size and shape the impact protection device will depend both the body part to be protected, the activity that is being engaged in, and the body size/shape of the particular user. For example, the device will be shaped and sized differently depending on whether it is being used to protect the groin region, chin, knee, elbow, head or other body part. Likewise, different activities may require a different shaped or sized device 10. For example, a jock cup being worn for soccer may be sized differently than one being worn for football. Furthermore, as shown above each component of the device may be customized based on the expected magnitude, direction and location of impact. Still further embodiments of the present invention are contemplated, including different combinations of aspects of the above-noted embodiments and embodiments that do not employ each of the noted aspects, such as a cup that has a version of a compressible layer 14 and a version of an impact shield 16 though no separate base member 12.

I claim:

1. An impact protection device for positioning adjacent a groin of a user comprising:

a cup-shape base member including an inner surface defining a cavity sized and shaped to be positioned adjacent the groin of the user, an outer surface and a peripheral edge;

an elastomeric cushioning layer over-molded to a portion of the inner surface, outer surface and peripheral edge of the base member, the elastomeric cushioning layer including a peripheral edge disposed adjacent to and surrounding the peripheral edge of the base member; and an impact shield secured to and extending over at least a portion of the outer surface of the base member such that it is positioned to receive an impact force directed generally toward the groin of the user, the impact shield including portions which engage the outer surface of the base member and portions which do not engage the outer surface of the base member.

2. The device of claim 1 wherein the base member comprises at least one opening and wherein the impact shield is attached to the base member at a plurality of discrete locations such that the impact shield extends over the opening.

3. The device of claim 1 wherein the base member comprises a rigid or semi-rigid material or composite of materials.

4. The device of claim 1 wherein the impact shield comprises a central portion and at least two leg portions extending from the central portion, wherein each leg portion operatively attaches to the base member at a discrete location.

5. The device of claim 1 wherein the impact shield comprises a rigid or semi-rigid material or composite of materials.

6. The device of claim 1 further comprising at least one shock absorber adjacent the impact shield and the base member.

7. The device of claim 6 further comprising a plurality of shock absorbers adjacent the impact shield and the base member at a plurality of discrete locations.

8. The device of claim 6 wherein the shock absorber includes a cushion disposed between the impact shield and the outer surface of the base member.

9. The device of claim 1 wherein the shock absorber comprises a connecting means operatively attaching the impact shield to the base member to provide limited relative movement between the impact shield and the base member upon the application of a force to the impact shield.

10. The device of claim 1 wherein the impact shield comprises a Y-shaped configuration extending along a vertical axis of the base member.

11. The impact protection device of claim 1 wherein the impact shield includes a peripheral edge, and wherein portions of the impact shield peripheral edge contact the base member or cushioning layer and portions of the impact shield peripheral edge do not contact the base member or cushioning layer.

12. The impact protection device of claim 1 wherein the impact shield includes a central portion and a plurality of leg portions, and wherein the leg portions are attached to the base member and the central portion does not engage the base member.

13. The impact protection device of claim 12 further comprising a cushion member disposed between each leg portion and the base member.

14. The impact protection device of claim 1 wherein the base member includes at least one opening at an apex portion of the base member, and wherein the impact shield extends over a portion of the at least one opening.

15. The impact protection device of claim 1 wherein the base member includes at least 2 openings at an apex portion of the base member, the openings being separated by a bridge, and wherein the impact shield extends over portions of both openings.

16. The impact protection device of claim 15 wherein the impact shield is adapted to contact the base member upon the application of an impact force.

17. The impact protection device of claim 13 wherein the cushioning layer extends from the peripheral edge along a portion of the outer surface to form the cushion members.

18. The impact protection device of claim 1 wherein the impact shield is permanently attached to the base member.

19. The impact protection device of claim 1 wherein the impact shield is riveted to the base member within portions of the impact shield that engage the outer surface of the base member.

20. The impact protection device of claim 19 wherein the elastomeric cushioning layer extends between the impact shield and the base member proximate where the impact shield is riveted to the base member.

21. The impact protection device of claim 12 further comprising a plurality of rivets, with each of the plurality of rivets extending through a corresponding one of the plurality of leg portions, thereby securing the impact shield to the base member.

22. The impact protection device of claim 1 wherein the impact protection device is configured for placement adjacent the groin of the user as a one-piece device.

23. The impact protection device of claim 22 wherein the impact protection device is configured to be secured to the user via a jock strap.

24. An impact protection device for positioning adjacent a groin of a user comprising:

a cup-shape base member including an inner surface defining a cavity sized and shaped to be positioned adjacent the groin of the user, an outer surface and a peripheral edge;

a cushioning layer over-molded to a portion of the inner surface, outer surface and peripheral edge of the base member, the cushioning layer comprising an elastomer and including a peripheral edge disposed adjacent to and surrounding the peripheral edge of the base member; and an impact shield secured to and extending over at least a portion of the outer surface of the base member such that it is positioned to receive an impact force directed generally toward the groin of the user, the impact shield including portions which engage the outer surface of the base member and portions which do not engage the outer surface of the base member.

25. The device of claim 24 wherein the base member comprises at least one opening and wherein the impact shield is attached to the base member at a plurality of discrete locations such that the impact shield extends over the opening.

26. The device of claim 24 wherein the base member comprises a rigid or semi-rigid material or composite of materials.

27. The device of claim 24 wherein the impact shield comprises a central portion and at least two leg portions extending from the central portion, wherein each leg portion operatively attaches to the base member at a discrete location.

28. The device of claim 24 wherein the impact shield comprises a rigid or semi-rigid material or composite of materials.

29. The device of claim 24 further comprising at least one shock absorber adjacent the impact shield and the base member.

30. The device of claim 29 further comprising a plurality of shock absorbers adjacent the impact shield and the base member at a plurality of discrete locations.

31. The device of claim 29 wherein the shock absorber includes a cushion disposed between the impact shield and the outer surface of the base member.

32. The device of claim 24 wherein the shock absorber comprises a connecting means operatively attaching the impact shield to the base member to provide limited relative movement between the impact shield and the base member upon the application of a force to the impact shield.

33. The device of claim 24 wherein the impact shield comprises a Y-shaped configuration extending along a vertical axis of the base member.

34. An impact protection device for positioning adjacent a groin of a user comprising:

a cup-shape base member including an inner surface defining a cavity sized and shaped to be positioned adjacent the groin of the user, an outer surface and a peripheral edge;

an elastomeric cushioning layer molded over a portion of the inner surface, outer surface and peripheral edge of the base member;

an impact shield secured to and extending over at least a portion of the outer surface of the base member such that it is positioned to receive an impact force directed generally toward the groin of the user, the impact shield including portions which engage the outer surface of the base member and portions which do not engage the outer surface of the base member, wherein the impact shield includes a central portion and a plurality of leg portions, and wherein the leg portions are attached to the base member and the central portion does not engage the base member; and a plurality of rivets each extending through a corresponding one of the plurality of leg portions, thereby securing the impact shield to the base member.

35. An impact protection system, comprising:

a jock strap; and an impact protection device configured to be secured adjacent to a groin of a user via the jock strap, the impact protection device comprising:

a cup-shape base member including an inner surface defining a cavity sized and shaped to be positioned adjacent the groin of the user, an outer surface and a peripheral edge, an elastomeric cushioning layer over-molded to a portion of the inner surface, outer surface and peripheral edge of the base member, the elastomeric cushioning layer including a peripheral edge disposed adjacent to and surrounding the peripheral edge of the base member; and an impact shield secured to and extending over at least a portion of the outer surface of the base member such that it is positioned to receive an impact force directed generally toward the groin of the user, the impact shield including portions which engage the outer surface of the base member and portions which do not engage the outer surface of the base member.

* * * * *